United States Patent [19]

Bahr

[11] Patent Number: 4,745,766

[45] Date of Patent: May 24, 1988

[54] DEHUMIDIFIER CONTROL SYSTEM

[75] Inventor: Chester A. Bahr, Rhine, Wis.

[73] Assignee: Kohler Co., Kohler, Wis.

[21] Appl. No.: 31,034

[22] Filed: Mar. 27, 1987

[51] Int. Cl.[4] ..... F25B 49/00

[52] U.S. Cl. ..... 62/176.6; 62/234; 62/156; 236/44 R

[58] Field of Search ..... 62/80, 234, 155, 150, 62/151, 156, 231, 157, 176.1, 176.2, 176.6, 282, 82, 180, 182; 236/44 R, 44 A, 44 C

[56] References Cited

U.S. PATENT DOCUMENTS

| | | | |
|---|---|---|---|
| 2,124,268 | 7/1938 | Williams | 62/115 |
| 2,130,036 | 9/1938 | Shrader | 62/4 |
| 2,691,870 | 10/1954 | Smith | 62/3 |
| 3,496,731 | 2/1970 | Sholtes | 62/176.1 |
| 3,759,049 | 9/1973 | Bell et al. | 62/80 |
| 4,056,948 | 11/1977 | Goodhouse | 62/155 |
| 4,344,294 | 8/1982 | Gelbard | 62/140 |
| 4,627,245 | 12/1986 | Levine | 62/234 |

OTHER PUBLICATIONS

Pamphlet "Home Dehumidifiers", Wisconsin Electric Power Company, 9/85.

*Primary Examiner*—Harry B. Tanner
*Attorney, Agent, or Firm*—Quarles & Brady

[57] ABSTRACT

A dehumidifier includes a humidistat switch to provide power to the compressor and fan when the ambient humidity exceeds a given level. The power to the compressor is also controlled by a thermostat switch and a timer. When the dehumidifier is operating in an environment that is below a given temperature, the compressor is periodically turned off for a short interval to melt any ice that has formed on the compressor coils.

7 Claims, 1 Drawing Sheet

DEHUMIDIFIER CONTROL SYSTEM

BACKGROUND OF THE INVENTION

The present invention relates to dehumidifier control systems which prevent the buildup of ice on the refrigerant coils in the dehumidifier.

Home dehumidifiers typically consist of a humidistatically controlled compressor for circulating a refrigerant, such as Freon (Trademark of E. I. duPont de Nemours & Co., Inc.), through sets of evaporator and condenser coils. An electric fan, also controlled by the humidistat, blows ambient air over the coils which causes moisture in the air to condense on the cold evaporator coils. The condensation then either drips into a pan or flows through a drain hose.

When a dehumidifier is in a cold environment, such as may be encountered in an unheated basement, if the ambient temperature falls low enough (e.g. below 65° F.), the evaporator coil surface temperature may drop below the freezing point. Ths causes ice to form on the evaporator coil creating an insulating layer which interferes with the dehumidification. Eventually, the ice builds up to the point where the air flow through the coil becomes completely blocked at which time the dehumidification process ceases. The dehumidifier then must be manually shut off in order for the temperature of the evaporator coil to rise above the freezing point allowing the ice to melt.

SUMMARY OF THE INVENTION

The control system for a dehumidifier includes a humidistat switch for applying power to the dehumidifier when the humidity in the ambient air is above a predetermined level. Connected to the humidistat is an electric fan which operates whenever the humidistat switch is closed. Also connected to the humidistat switch is a compressor control circuit consisting of the series connection of a thermostat switch and the compressor motor. A separate time actuated switch is also included for periodically providing a conductive path in parallel to the thermostat switch.

One of the objects of the present invention is to provide a means for preventing ice buildup on the evaporator coils of a dehumidifier.

Another object of the present invention is to periodically cycle the operation of the compressor of the dehumidifier while continuing to blow air across the evaporator coils to prevent ice buildup when the ambient air drops below a given temperature.

A further object is to increase the efficiency of the dehumidifier by limiting the formation of an insulating layer of ice on the evaporator coils.

BRIEF DESCRIPTION OF THE DRAWING

The FIGURE is a schematic diagram of the dehumidifier incorporating the present invention.

DETAILED DESCRIPTION OF THE PREFERRED EMBODIMENT

Figure 1:
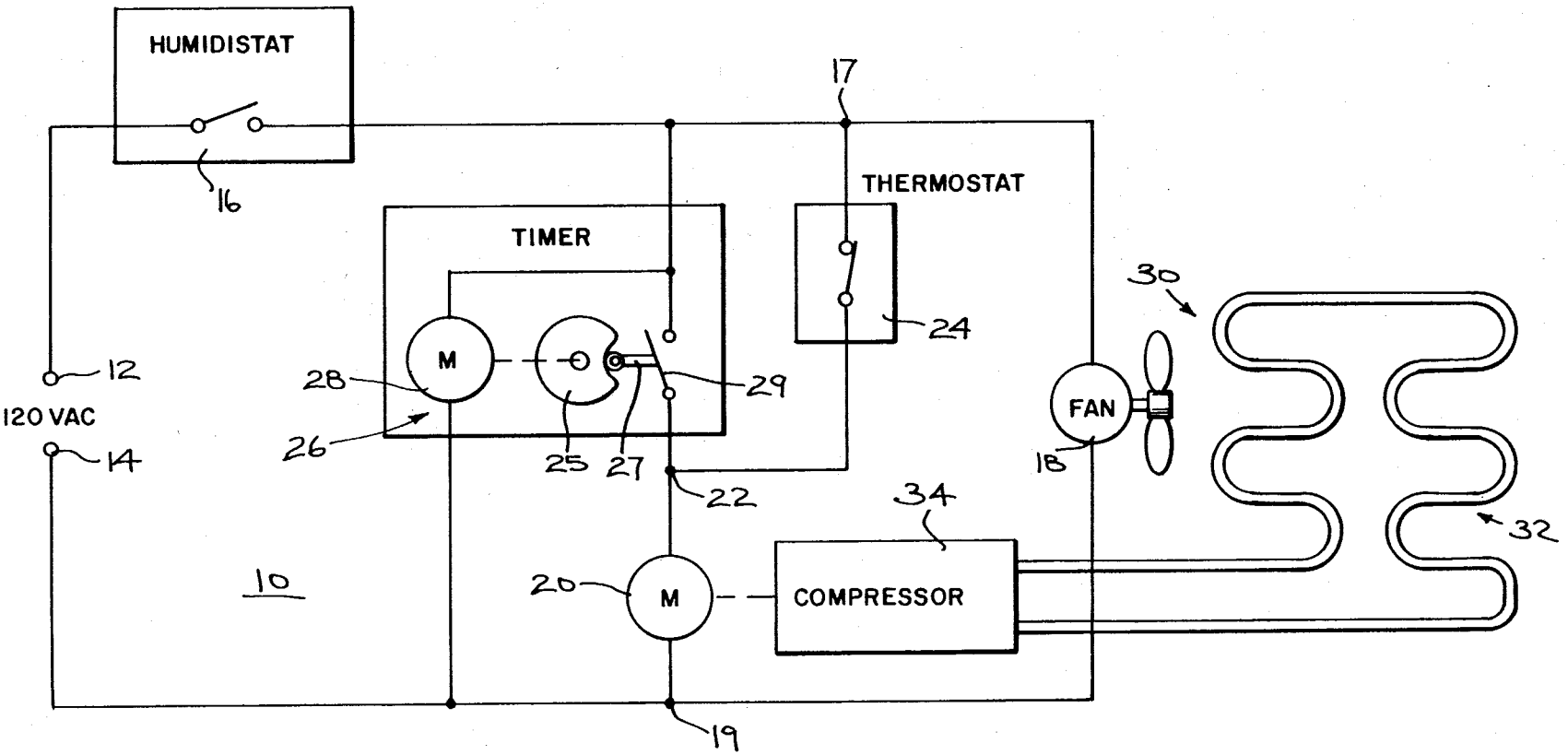

As shown in the accompanying drawing, a dehumidifier, generally designated as 10, includes two terminals 12 and 14 to which 120 volts of alternating electric current is applied to provide power to the dehumidifier. One of the power terminals 12 is connected to one contact of a humidistat switch 16. The humidistat operation is adjustable so that switch 16 will close when the humidity in the ambient air is above a predetermined level. A second contact of the humidistat switch 16 is connected to a first terminal 17 of the motor for an electric fan 18. A second terminal 19 of the fan 18 is connected to the other power terminal 14.

Connected in parallel with the fan 18 is the dehumidifier compressor circuit including motor 20 for driving a compressor 34. The compressor motor 20 has one terminal connected to the second power terminal 14 and to the second terminal of the fan 18. Another terminal of the compressor motor 20 is connected to node 22. Compressor 34, when driven by motor 20, causes a refrigerant to flow through evaporator and condensor coils 30 and 32 respectively.

A thermostat switch 24 is connected between the first terminal 17 of the electric fan 18 and node 22. The thermostat switch 24 is adjustable so that the switch will open when the ambient air drops below a selected temperature. Alternatively a thermostat switch with a fixed temperature setting can be used.

A timer 26 has a switch 29 connected in parallel with the thermostat switch 24. The timer 26 cycles its switch 29 through periods of conductive and nonconductive states as described below. The timer periods may be fixed or variable. Although the timer 26 may be any of several types fulfulling this function, the instant timer has a motor 28 connected in parallel with the fan 18. The timer motor 28, which is activated whenever the humidistat switch 16 applies power to the electric fan 18, drives a mechanical coupling to open and close the timer switch 29. As schematically illustrated in the drawing, the motor 28 drives a cam wheel 25 with a cam follower 27 connected to the timer switch 29.

Under a condition of high humidity in the ambient of the dehumidifier 10, the humidistat switch 16 will close, turning on the electric fan 18 and blowing ambient air through an evaporator coil 30 connected to the compressor 34. Assuming initially that the temperature of the ambient air is relatively warm, the thermostat switch 24 will be closed supplying power to the compressor motor 20. This drives the compressor 34 which circulates the refrigerant through the condenser and evaporator coils 32 and 30, respectively. In this situation the timer motor 28 is activated, periodically opening and closing the switch 29. However, since the thermostat 24 provides a parallel conductive path to that of the timer switch 29, the compressor motor 20 runs continuously.

A second situation exists when the humidity is above the preset level so that humidistat switch 16 is closed, but the temperature has dropped below the setting of the thermostat switch, e.g. below 65 degrees Fahrenheit. In this case thermostat switch 24 will be open. As long as the temperature remains below the temperature setting of thermostat switch 24, the operation of the compressor motor 20 will be controlled by the timer 26. In this mode, the timer motor 28 cycles the switch 29 through open and closed states periodically disconnecting the power to the compressor motor 20 to stop the flow of refrigerant through the coils 30 and 32. For example, the timer 26 may cause the compressor motor to run for fifteen to twenty minutes and then turn off for a period of forty-five to sixty seconds. Although a shorter off period may be adequate to prevent ice buildup, the off period must be sufficiently long so that pressures throughout the refrigerant system bleed to a uniform level. If the pressures do not equalize within the system, the compressor may be overtaxed upon restarting at the end of the off portion of the control cycle. The off time may be selected for a given environment so that the temperature of the evaporator coil 30 never rises above the dew point. This results in the dehumidification process continuing even when ice is melting. During these hiatuses in the compressor operation, fan 18 continues circulating relatively warm air over the coils 30 and 32 to melt any ice on the evaporator coil 30.

The present dehumidifier operates intermittently when the ambient temperature falls below the point where normal air flow will not prevent ice buildup on the coils. This condition is sensed by the thermostat switch 24 which responds by permitting the timer switch 29 to control the compressor operation. Although simply turning off the compressor 34 for a long period of time would eventually allow the ice to melt, the melting period is shortened by leaving the fan 18 operating.

I claim:

1. A dehumidifier comprising:

an evaporator coil;

a condensor coil;

a compressor for circulating a refrigerant through the evaporator and condensor coils;

a fan for circulating air over the evaporator coil;

humidistatically controlled means for applying power to the compressor and the fan; and means for periodically disconnnecting the application of power to said compressor when the ambient temperature falls below a given value.

2. The dehumidifier as recited in claim 1 wherein said means for periodically disconnecting the application of power to said compressor comprises;

a timer activated device connecting the compressor to the means for applying power; and a thermostat controlled device connecting the compressor to the means for applying power.

3. The dehumidifier as recited in claim 1 wherein said means for periodically disconnecting disconnects the power for an interval selected so that the temperature of said evaporator coil does not rise substantially above the dew point when said humidistat is applying power.

4. A dehumidifier comprising:

first and second power terminals for applying electrical power to the dehumidifier;

an electric fan having first and second terminals, the first terminal being connected to said first power terminal;

a humidistat controlled switch for coupling said second power terminal to the second terminal of the electric fan;

a compressor including a motor having first and second terminals, the first terminal being connected to one of the first and second terminals of said electric fan;

a condenser coupled to said compressor;

an evaporator coupled to said compressor and said condensor;

a thermostat controlled switch connected between the second terminal of said compressor motor and the other one of the first and second terminals of said electric fan; and a switch means for periodically providing a conductive path between the second terminal of said compressor motor and the other one of said first and second terminals of said electric fan.

5. The dehumidifier control system as in claim 4, wherein said switch means comprises a timer for periodically opening and closing the conductive path.

6. A method of operating a dehumidifier having a fan, a compressor, an evaporator coil, a condenser coil and a humidistat switch for activating the dehumidifier when the ambient humidity is above a preselected level, said method comprising:

periodically stopping the operation of the compressor for a given interval when the ambient temperature is below a given value; and operating the fan during the given interval.

7. The method as recited in claim 6 further comprising the step of selecting the given interval so that the temperature of the evaporator coil does not rise substantially above the dew point when the humidistat switch is activating the dehumidifier.

* * * * *